US005558967A

United States Patent [19]

Nagatsuka et al.

[11] Patent Number: 5,558,967

[45] Date of Patent: Sep. 24, 1996

[54] TONER FOR DEVELOPING ELECTROSTATIC IMAGE AND TWO-COMPONENT TYPE DEVELOPER FOR DEVELOPING ELECTROSTATIC IMAGE

[75] Inventors: Takayuki Nagatsuka, Yokohama; Takashige Kasuya, Soka; Tatsuya Nakamura, Tokyo; Makoto Kanbayashi, Kawasaki; Tatsuhiko Chiba, Tokyo, all of Japan

[73] Assignee: Canon Kabushiki Kaisha, Tokyo, Japan

[21] Appl. No.: 332,474

[22] Filed: Oct. 31, 1994

Related U.S. Application Data

[63] Continuation of Ser. No. 944,898, Sep. 15, 1992, abandoned.

[30] Foreign Application Priority Data

Sep. 19, 1991 [JP] Japan ..... 3-268202
Aug. 31, 1992 [JP] Japan ..... 4-231975

[51] Int. Cl.[6] ..... G03G 9/087

[52] U.S. Cl. ..... 430/106.6; 430/109; 430/110; 430/137

[58] Field of Search ..... 430/106.6, 109, 430/110, 137

[56] References Cited

U.S. PATENT DOCUMENTS

| | | | |
|---|---|---|---|
| 2,297,691 | 10/1942 | Carlson | 95/5 |
| 4,904,558 | 2/1990 | Nagatsuka et al. | 430/122 |
| 5,102,761 | 4/1992 | Ohsaki et al. | 430/109 |
| 5,116,712 | 5/1992 | Nakamura et al. | 430/106 |
| 5,130,219 | 7/1992 | Mori et al. | 430/106 |
| 5,130,220 | 7/1992 | Mori et al. | 430/109 |
| 5,135,833 | 8/1992 | Matsunaga et al. | 430/110 |
| 5,143,812 | 9/1992 | Mori et al. | 430/124 |
| 5,219,946 | 6/1993 | Tanikawa et al. | 524/112 |
| 5,354,640 | 10/1994 | Kanbayashi et al. | 430/110 |

FOREIGN PATENT DOCUMENTS

| | | |
|---|---|---|
| 0230041 | 7/1987 | European Pat. Off. . |
| 0376202 | 7/1990 | European Pat. Off. . |
| 60-238846 | 11/1985 | Japan . |

OTHER PUBLICATIONS

Section Ch, Week 9233, Derwent Publications Ltd., Class G06, AN 92–272239 for JPA 4–184358, published Jul. 1, 1992.

Section Ch, Week 8219, Derwent Publications Ltd., Class G06, AN 82–38082E, for JPA 57–054949, published Apr. 1, 1982.

Section Ch, Week 8825, Derwent Publications Ltd., Class G05, AN 88–171626 for JPA 63–109447, published Oct. 27, 1986.

Translation of JP 4–184358; Jul. 1, 1992.

*Primary Examiner*—Christopher D. Rodee

*Attorney, Agent, or Firm*—Fitzpatrick, Cella, Harper & Scinto

[57] ABSTRACT

A toner and a two-component developer for developing electrostatic images are disclosed. The toner comprises toner particles and the two-component developer comprises the toner and a carrier. The toner particle has a two-layer structure of a core layer and a surface layer, produced by suspension polymerization. The core layer and surface layer are mainly comprised of a resin having a low softening point and a resin having a high softening point, respectively. In the surface layer, a polyester resin having a specific acid value and a specific molecular weight is included to impart an appropriate water absorption to the toner. Due to the appropriate water absorption and superior fluidity, the toner can achieve a speedy rise of charge to give electrostatic charges in a stable quantity over a long period of time, and it can give a high image density and images with superior fine-line reproduction and highlight reproduction.

69 Claims, No Drawings

TONER FOR DEVELOPING ELECTROSTATIC IMAGE AND TWO-COMPONENT TYPE DEVELOPER FOR DEVELOPING ELECTROSTATIC IMAGE

This application is a continuation of application Ser. No. 07/944,898 filed Sep. 15, 1992, now abandoned.

BACKGROUND OF THE INVENTION

1. Field of the Invention

The present invention relates to a toner for developing an electrostatic image, and a two-component type developer for developing an electrostatic image which contains the toner and a carrier.

2. Related Background Art

In electrophotography, a large number of methods are conventionally known, as disclosed, for example, in U.S. Pat. No. 2,297,691. In general, in electrophotography, an electrostatic latent image is formed on a photosensitive member utilizing a photoconductive material and according to various means. Subsequently, the latent image is developed using a toner to form a toner image. Then the toner image is transferred to a recording medium such as paper if necessary, followed by fixing by the action of heat and/or pressure or solvent vapor. A copy is thus obtained. As methods of carrying out development using a toner or methods of fixing toner images, various means have been hitherto proposed, and means suited for their image forming processes have been employed. In recent years, electrophotography is required to achieve higher-speed copying and higher image quality.

Toners are commonly known to be produced by a process comprising melt-mixing or dispersion-mixing additives such as a dye or pigment in a thermoplastic resin to effects uniform dispersion, followed by pulverization and classification to produced a toner having the desired particle diameter.

The toners obtained by such pulverization are usually amorphous and hence have had a limit in achievement of the reproduction faithful to the latent image, which is disadvantageous for making image quality higher. In order to achieve a higher image quality in the toners produced by pulverization, toners must be pulverized to have smaller particle diameters. Making the particle diameters smaller, however, has been problematic in that it requires a greater energy and results in a poor toner yield.

On the other hand, toners obtained by suspension polymerization (hereinafter "polymerization toner(s)") can be free from the above disadvantages. In addition, they can allow a wax to be internally held and hence make it possible to achieve good fixing performance and anti-offset properties.

It, however, has become clear that, when particle diameters are made smaller in the polymerization toners, electrostatic charges suitable for a high image quality can not be readily obtained in a stable quantity. Since the polymerization toners are obtained by granulation in an aqueous medium, polar materials such as a charge control agent localize at particle surfaces. This phenomenon may give an excess charge even when a charge control agent is added in a smaller quantity, and use of the charge control agent in a much smaller quantity brings about the problem that the rise of charge becomes slow. Use of a charge control agent having weak charge-providing properties also tends to bring about the problem that the rise of charge becomes slow.

Japanese Patent Application Laid-open No. 60- 238846 discloses a toner containing a saturated polyester. It is true that a toner containing a polyester resin can achieve a sharp particle size distribution. In the toner performances such as charge characteristics, however, unsatisfactory results may be obtained in respect of the speed of rise of charge and the stability in quantity of electrostatic charges over a long period of time.

SUMMARY OF THE INVENTION

An object of the present invention is to provide a toner for developing an electrostatic image, that has solved the problems discussed above, and a two-component type developer for developing an electrostatic image which contains such a toner and a carrier.

Another object of the present invention is to provide a toner for developing an electrostatic image, that can be suited for high-speed image formation and full-color formation,, can achieve a speedy rise of charge and can obtain electrostatic charges in a stable quantity over a long period of time, and a two-component type developer for developing an electrostatic image which contains such a toner and a carrier.

Still another object of the present invention is to provide a toner for developing an electrostatic image, having a superior fluidity, that can give a high image density and an image with superior fine-line reproduction and highlight reproduction, and a two-component type developer for developing an electrostatic image which contains such a toner and a carrier.

A further object of the present invention is to provide a toner for developing an electrostatic image, that has superior fixing performance and blocking resistance, and a two-component type developer for developing an electrostatic image which contains such a toner and a carrier.

The objects of the present invention can be achieved by a toner for developing an electrostatic image, comprising toner particles, wherein;

said toner particles contain from 0.1% by weight to 15% by weight of a polyester resin having an acid value of from 5 mg KOH/g to 50 mg KOH/g and a weight average molecular weight of from 1,000 to 14,000, and from 16% by weight to 50% by weight of a paraffin wax having a melting point of from 50° to 90° C.;

resin components in said toner particles have a weight average molecular weight of from 5,000 to 45,000;

said toner particles are prepared by suspension polymerization of a monomer composition containing at least polymerizable monomers, a paraffin wax and a polyester resin; and said toner has a water absorption of from 300 ppm to 5,000 ppm.

The objects of the present invention can also be achieved by a two-component type developer for developing an electrostatic image, which comprises a toner comprising toner particles, and a carrier, wherein said toner particles contain from 0.1% by weight to 15% by weight of a polyester resin having an acid value of from 5 mg KOH/g to 50 mg KOH/g and a weight average molecular weight of from 1,000 to 14,000, and from 16% by weight to 50% by weight of a paraffin wax having a melting point of from 50° to 90° C.;

resin components in said toner particles have a weight average molecular weight of from 5,000 to 45,000;

said toner particles are prepared by suspension polymerization of a monomer composition containing at least polymerizable monomers, a paraffin wax and a polyester resin;

said toner has a water absorption of from 300 ppm to 5,000 ppm; and said carrier comprises magnetic particles.

DESCRIPTION OF THE PREFERRED EMBODIMENTS

As a result of extensive studies, the present inventors have discovered that a good charge performance can be exhibited when a toner comprising toner particles has a water absorption ranging between 300 ppm and 5,000 ppm. Thus the toner comprising toner particles should have a water absorption of from 300 to 5,000 ppm, and preferably from 500 to 3,000 ppm. The toner having a water content of 300 ppm or more is in a form wherein charges generated can be readily moved, and hence the rise of charge is considered to become improved. Such an improved state in the rise of charge makes it possible to obtain electrostatic charges in a quantity at a proper level by selecting the amount or kind of a charge control agent being added. In the case when the toner comprising toner particles has a water absorption of less than 300 ppm, the rise of charge may become slow to make it necessary to improve the rise of charge by increasing the amount of a charge control agent. Increasing the amount of a charge control agent, however, is not preferable since it often causes a serious inhibition of granulation performance during the manufacture of the toner and also an inhibition of polymerization.

In the case when the toner comprising toner particles has a water absorption of more than 5,000 ppm, the electrostatic charges become very readily movable, undesirably resulting in a rapid leak of charges.

An external additive used in toner particles prepared using a toner resin having a relatively high water absorption should preferably be hydrophobic. That is, when the toner is left to stand in an environment of high temperature and high humidity, the leak of charges may become rapid as a developer since charges are in a readily movable state not only in the toner particles but also in the external additive. Thus, this phenomenon tends to occur unless the external additive is hydrophobic, and may cause scattering of toner and fogging. An inorganic oxide used as the external additive may preferably have a hydrophobicity of not less than 10%.

It is preferable in the present invention to externally add a hydrophobic inorganic oxide having a specific surface area of not less than 80 $m^2/g$ as measured by the BET method. An inorganic oxide having a specific surface area of less than 80 $m^2/g$ can not impart a satisfactory fluidity and besides may make it difficult to uniformly cover the surfaces of toner particles, making the present invention less operative and effective.

The inorganic oxide may include silica, alumina and titanium oxide, which are preferable because of their readiness to take the form of fine particles. Examples are by no means limited to these.

A preferable means for controlling the toner to have the water absorption of from 300 to 5,000 ppm is to incorporate a polyester resin in the surface layers of the toner particles. Such a toner can be obtained by producing toner particles by subjecting to suspension polymerization a monomer composition comprising a polyester resin dissolved in polymerizable monomers used for the suspension polymerization.

The polyester resin has carbonyl groups serving as water absorbing sites and hence is a resin having a high water absorption. It also exhibits a negative chargeability with a speedy rise.

Accordingly, it is optimum to incorporate the polyester resin in the surface layers of the toner particles used in the present invention.

In a preferred embodiment of the present invention, the toner particles may each preferably have a structure comprised of at least two components, A and B, and separated into a phase mainly composed of component-A and a phase mainly composed of component-B. The phase mainly composed of component-A (phase-A) constitutes the surface layer, and the phase mainly composed of component-B (phase-B) is present at the core. A preferable combination is set up when the phase-A comprises a resin having a high softening point, and the phase-B comprises a resin having low softening point. There are no limitations so long as it is a combination in which the structure is separated into the phase-A and phase-B when formed as the toner particle. Herein, what is meant by "mainly composed" is that the component has the greatest molar component ratio in the constituents.

In such an embodiment, the aforesaid polyester resin is included in the phase-A, i.e., present in the phase-A together with the component-A mainly composing the phase-A. The polyester resin is presumed to be localized at the outermost surfaces of the toner particles or dispersed in the vicinity thereof, because of its polarity that acts during suspension polymerization.

The toner particles of the present invention contain resin components having a weight average molecular weight Mw of from 5,000 to 45,000, and preferably from 8,000 to 42,000, in the molecular weight distribution as measured by GPC (gel permeation chromatography), and may preferably have a flow-out point of from 65° to 100° C. as measured using a flow tester. The resin components having this weight average molecular weight may preferably be comprised of the component-A resin mainly composing the phase-A and the polyester resin included in the phase-A, in other words, the weight average molecular weight of from 5,000 to 45,000 includes the weight average molecular weight of the polyester resin. As the component-A that constitutes the phase-A, any resins can be used so long as they are obtained by suspension polymerization, which may have a functional group that can serve as a charge site and a functional group that can improve adhesion to a recording medium such as paper. In the case when the resins that constitute the phase-A have a weight average molecular weight Mw of less than 5,000, the toner may have a poor blocking resistance. In the case when they have a weight average molecular weight Mw of more than 45,000, color mixing properties required for color toners may become poor.

Polymerizable monomers that can be used in the suspension polymerization for preparing the toner particles described above and may form the component-A mainly composing the phase-A, include styrene monomers such as styrene, o-methylstyrene, m-methylstyrene, p-methylstyrene, p-methoxystyrene and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylates such as methyl methacrylate, ethyl methacrylate, n-propyl methacrylate, n-buryl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylonitrile monomers; methacrylonitrile monomers; and acrylamide monomers.

Any of these monomers may be used alone or in combination. Of the above monomers, it is preferable from the viewpoint of developing performance and durability of the toner to use styrene monomers alone or in combination with other monomer(s).

As the component-B preferably used in the present invention is a paraffin wax having a melting point of from 50° to 90° C., and preferably from 60° to 80° C.

In the case when the component-B has a melting point below 50° C., low-temperature offset may be promoted during fixing to give a bad influence. In an environment of high temperature, an additional problem may occur such that migration of the polyester resin localized at the surface layers of toner particles tends to occur to make charge performance poor. In the case when the component-B has a melting point above 90° C., the component-B may be solidified during the preparation of the toner particles to bring about the problem of a lowering of granulation performance.

The paraffin wax of this component-B may include paraffin, oxides thereof, and modified products of paraffin such as grafted products thereof.

The paraffin wax used in the present invention may be added in an amount of from 16% to 50% by weight, preferably from 16% to 40% by weight, and more preferably from 16% to 30% by weight, on the basis of the weight of the polymerizable monomers. Its addition in the amount within this range makes it easy to obtain the particle structure of toner particles as previously described. More specifically, in the polymerization toner, because of the features of its manufacturing process, the hydrophobic material such as wax tends to be localized in the interiors of toner particles, and on the other hand the hydrophilic material tends to be localized at the surfaces of toner particles.

Addition of the paraffin wax in an amount less than 16% by weight not only makes it impossible to obtain a good fixing performance but also makes it difficult for the polyester resin to be localized at the surface layers of the toner particles as a feature of the present invention, which prevents the satisfactory effect aimed at in the present invention. Namely, a force by which the wax present at the core of a toner particle directs the polyester resin toward the surface layer of the toner particle does not act until the wax is contained in an amount of not less than 16% by weight. Addition of the wax in an amount more than 50% by weight is not preferable since it may be greatly harmful to the stability during granulation to give unsatisfactory toner particles.

In the present invention, the polyester resin, which is an anionic polymer, is added to the monomer composition as a resin having a polar group, to carry out the polymerization.

As the polyester resin used in the present invention, it is possible to use resins having an acid value of from 5 to 50 mg KOH/g, and preferably an acid value of from 5 to 40 mg KOH/g, and a weight average molecular weight of from 1,000 to 14,000, and preferably a weight average molecular weight of from 5,000 to 14,000.

Hence, it is possible to use broadly various kinds of polyester resins comprising a polybasic acid and a polyhydric alcohol. For example, as acid component monomers, terephthalic acid, isophthalic acid, phthalic acid, fumaric acid, maleic acid, malonic acid, succinic acid, glutaric acid, adipic acid, pimelic acid, suberic acid, azelaic acid, sebacic acid, campholic acid, cyclohexanedicarboxylic acid and trimellitic acid are useful. As alcohol component monomers, alkylene glycols or polyalkylene glycols such as ethylene glycol, diethylene glycol, triethylene glycol, 1,2-propylene glycol, 1,3-propylene glycol, 1,4-butanediol, neopentyl glycol and 1,4-bis(hydroxymethyl)cyclohexane, bisphenol A, hydrogenated bisphenols, ethylene oxide addition products of bisphenol A, propylene oxide addition products of bisphenol A, glycerol, trimethylol propane and pentaerythritol are useful. Polyester resins obtained by any desired combination of these can be effectively used so long as they are soluble in the polymerizable monomers used in the present invention.

The polyester resin described above may be added in an amount of from 0.1% to 15% by weight, preferably from 0.5% to 12% by weight, and more preferably from 1% to 10% by weight, on the basis of the weight of the polymerizable monomers used. Addition of the polyester resin in an amount less than 0.1% by weight on the basis of the weight of the polymerizable monomer may give an unsatisfactory rise of charge which is an effect disireal in the present invention. Its addition in an amount more than 15% by weight on the basis of the weight of the polymerizable monomers may cause a poor dispersion of colorants, resulting in a poor granulation performance.

These polyester resins should preferably have a water absorption of not less than 1,000 ppm, and may preferably have a water absorption of not less than 2,000. Any polyester resins can have a high water absorption even if they have no excessive acid value, and hence can readily keep a balance between water absorption and other physical properties.

In the case when the polyester resin used in the present invention has an acid value less than 5 mg KOH/g, it may be incompletely localized at the toner particle surfaces, resulting in unsatisfactory rise of charge. In the case when it has an acid value more than 50mg KOH/g, it may be incompletely dissolved in the polymerizable monomers, resulting in unsatisfactory granulation performance.

In the case when the polyester resin has a weight average molecular weight less than 1,000, it follows that a polyester resin with a low molecular weight is localized at the toner particle surfaces, and hence the blocking resistance of the toner obtained may become poor. In the case when it has a weight average molecular weight more than 14,000, the dispersibility of colorants may be lowered, and the granulation performance may become poor.

In the present invention, other polar polymer (resin having a polar group) may also be added to the monomer composition in combination with the specific polyester resin described above, to carry out the polymerization. Examples of other polar resin usable in the present invention are shown below.

A cationic polymer may include polymers of nitrogen-containing monomers as exemplified by dimethylaminoethyl methacrylate and diethylaminoethyl methacrylate, or copolymers of such nitrogen-containing monomers with styrene monomers or unsaturated carboxylic acid ester monomers.

An anionic polymer may most preferably include polyester resins, also including polymers of nitrile monomers such as acrylonitrile, halogen-containing monomers such as vinyl chloride, unsaturated carboxylic acid monomers such as acrylic acid and mathacrylic acid, unsaturated dibasic acid monomers, unsaturated dibasic acid anhydride monomers, and homopolymers or copolymers of monomers such as nitro monomers or copolymers of such monomers with styrene monomers.

Such other polar polymer may preferably be added in an amount of from 0.1% to 15% by weight, more preferably from 0.5% to 12% by weight, and still more preferably from 1% to 10% by weight, on the basis of the weight of the polymerizable monomers.

Such other polar polymer may preferably be those having a water absorption of not less than 1,000 ppm, and more preferably a water absorption of not less than 2,000 ppm. This range is preferable in view of the feature that the water absorption of the toner is controlled within the range of from 300 to 5,000 ppm.

In a dispersion medium used to carry out the suspension polymerization of the monomer composition in the present invention, a suitable dispersion stabilizer may be used, which may be either an inorganic compound or an organic compound as shown below. For example, the inorganic compound may include calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. The organic compound may include polyvinyl alcohol, gelatin, methyl cellulose, methyl hydroxypropylcellulose, ethyl cellulose, sodium salts of carboxymethyl cellulose, polyacrylic acids and salts thereof, and starch. Any of these dispersion stabilizers may be dispersed in an aqueous dispersion medium when used. The dispersion stabilizer may preferably be used in an amount of from 0.2 part to 20 parts by weight based on 100 parts by weight of the polymerizable monomers.

In order to finely disperse the dispersion stabilizer, a surface active agent may also be used in an amount of from 0.001 to 0.1 part by weight based on 100 parts by weight of the polymerizable monomers. This surface active agent is used to accelerate the intended action of the dispersion stabilizer described above. As examples thereof, it may include sodium dodecylbenzenesulfonate, sodium tetradecylsulfate, sodium pentadecylsulfate, sodium octylsulfate, sodium oleate, sodium laurate, potassium stearate and calcium oleate.

In the case when calcium phosphate is used among these dispersion stabilizers, preferable particle size distribution, toner particle form and toner particle structure can be obtained, and the present invention can be made more effective.

The calcium phosphate may be used in a powdery form as it is. It may preferably be used in the form of calcium phosphate produced in water by the use of materials such as sodium phosphate and calcium chloride. Use of this method can achieve a good granulation performance since a very fine salt can be obtained to give a stable state of suspension. As for the toner particle form, particle surfaces can have unevenness (or concavities and convexities) in preferable size and number. Moreover, because of stable oil droplets, the phase separation between the phase-A and phase-B can be promoted to give a preferable toner particle structure.

The toner particles used in the present invention can be obtained by the process as described below.

The monomer composition comprising polymerizable monomers, and added therein a release agent, a colorant, a charge control agent, a polymerization initiator and other additives, which are uniformly dissolved or dispersed therein by means of a mixing machine such as a homogenizer or an ultrasonic dispersion machine, is dispersed in the aqueous dispersion medium containing a dispersion stabilizer, by means of a conventional mixing machine such as a homomixer or a homogenizer. Granulation is carried out preferably while controlling the stirring speed and time so that monomer droplets can have the desired toner particle size, usually particle diameters of 30 μm or less. After the granulation, stirring may be carried out to such an extent that the state of particles ifs maintained and the particles can be prevented from floating or settling by the acton of the dispersion stabilizer. After the reaction has been completed, the dispersion stabilizer is removed, and the toner particles formed are collected by washing and filtration, followed by drying. In the suspension polymerization, water may preferably be used as a dispersion medium usually in an amount of from 300 to 3,000 parts by weight based on 100 parts by weight of the monomer composition.

In the above process, the polymerization may be carried out at a polymerization temperature set at 40° C. or higher, usually from 50° to 90° C.

During this polymerization, the temperature may preferably be controlled so that it is raised by 5° to 30° C. in the course of the progress of polymerization. Raising the temperature is presumed to promote the phase separation between the phase-A and phase-B.

The polymerization initiator may be any suitable polymerization initiator including, for example, azo or diazo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile, and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide. Any of these polymerization initiators may be added in an amount of from 0.5% to 20% by weight on the basis of the weight of the polymerizable monomers. In the present invention, a cross-linking agent may be used, which may preferably be added in an amount of from 0.001% to 15% by weight on the basis of the weight of the polymerizable monomers.

In the present invention, a charge control agent may preferably have been added in the toner materials for the purpose of controlling the chargeability of the toner. Among known charge control agents, those having neither polymerization inhibitory action nor aqueous-phase transfer properties are used as the charge control agent. For example, a positive charge control agent may include Nigrosine dyes, triphenylmethane dyes, quaternary ammonium salts, and amine type compounds or polypolyamine type compounds. A negative charge control agent may include metal-containing salicylic acid compounds, metal-containing monoazo dye compounds, styrene-acrylic acid copolymers and styrene-methacrylic acid copolymers. This charge control agent may be added in an amount of from 0.1% to 10% by weight on the basis of the weight of the polymerizable monomers. Its addition in an amount less than 0.1% by weight can not give a good rise of charge which is an effect desiral in the present invention. Its addition in an amount more than 10% by weight is not preferable since the inhibition of polymerization tends to occur.

As the colorant used in the present invention, known colorants can be used, as exemplified by dyes such as carbon black, black iron oxide, C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Pigment Blue 15, C.I. Basic Blue 3, C.I. Basic Blue 5, C.I. Mordant Blue 7, C.I. Direct Green 6, C.I. Basic Green 4 and C.I. Basic Green 6, and pigments such as chrome yellow, cadmium yellow, mineral first yellow, navel yellow, Naphthol Yellow S, Hanza Yellow G, Permanent Yellow NCG, Tartrazine Lake, molybdenum orange, Permanent Orange GTR, Benzidine Orange G, cadmium red, C.I. Pigment Red 122, Permanent Red 4R, Watchung Red calcium salt, Brilliant Carmine 3B, Fast Violet B, Methyl Violet Lake, prussian blue, cobalt blue, Alkali Blue Lake, Victoria Blue Lake, quinacridone, Rhodamine Lake, Phthalocyanine Blue, Fast Sky Blue, Pigment Green B, Malachite Green Lake and Final Yellow Green.

Since in the present invention the toner is obtained by polymerization, attention must be paid to the polymerization inhibitory action and aqueous-phase transfer properties inherent in the colorant. The colorant should more preferably be previously subjected to surface modification, for example, hydrophobic treatment using a material free from inhibition of polymerization. In particular, many of dyes and carbon black have the polymerization inhibitory action and hence attention must be paid when they are used. A preferable method for the surface treatment of the dyes may include a method in which polymerizable monomers are polymerized in the presence of those dyes. The resulting colored polymer may be added to the monomer composition. With regard to the carbon black, it is preferable, besides the same treatment on the dyes, to carry out grafting using a material capable of reacting with surface functional groups of the carbon black, as exemplified by polyorganosiloxane. In the present invention, a magnetic material may be added, which also may preferably be used after it has been subjected to surface treatment.

The toner particles used in the present invention should preferably have a weight average particle diameter of from 2 to 12 μm, and more preferably from 4 to 9 μm.

Additives used in the present invention for the purpose of providing various properties may include, besides the hydrophobic inorganic oxide, 1) Fluidity-providing agents: Carbon black and carbon fluoride.
2) Abrasives: Metal oxides as exemplified by cerium oxide, aluminum oxide, magnesium oxide and chromium oxide, nitrides as exemplified by silicon nitride, carbides as exemplified by silicon carbide, and metal salts as exemplified by strontium titanate, calcium sulfate, barium sulfate and calcium carbonate.
3) Lubricants: Fluorine resin powders as exemplified by vinylidene fluoride and polytetrafluoroethylene, and fatty acid metal salts as exemplified by zinc stearate and calcium stearate.
4) Charge controlling particles: Metal oxides as exemplified by tin oxide, titanium oxide, zinc oxide, silicon oxide and aluminum oxide, and carbon black.

Any of these additives may be used in an amount of from 0.1 part to 10 parts by weight, and preferably from 0.1 part to 5 parts by weight, based on 100 parts by weight of the toner particles. These additives may be used alone or in combination.

In the present invention the particle size distribution is measured in the manner as described below.

Coulter counter Type TA-II (manufactured by Coulter Electronics, Inc.) is used as a measuring device. An interface (manufactured by Coulter Electronics, Inc.) is used as a measuring device. An interface (manufactured by Nikkaki K. K.) that outputs number average distribution and volume average distribution and a personal computer CX-1 (manufactured by Canon Inc.) are connected. As an electrolytic solution, an aqueous 1% NaCl solution is prepared using sodium chloride (extra pure reagent).

Measurement is carried out by adding as a dispersant from 0.1 to 5 ml of a surface active agent, preferably an alkylbenzene sulfonate, to from 100 to 150 ml of the above aqueous electrolytic solution, and further adding from 0.5 to 50 mg of a sample to be measured. The electrolytic solution in which the sample has been suspended is subjected to dispersing treatment for about 1 minute to about 3 minutes using an ultrasonic dispersion device. The particle size distribution of particles of 2 μm to 40 μm is measured by means of the above Coulter counter Type TA-II, using an aperture of 100 μm as its aperture. Then the volume average distribution and number average distribution are determined.

Weight average particle diameter D4 is obtained from these volume average distribution and number average distribution thus determined.

The melting point of the wax in the present invention is measured using DSC-7 (manufactured by Perkin Elmer Co.,), raising temperatures at a rate of 10° C./min. The peak top temperature at which a maximum absorption of heat is indicated in the DSC curve at the first temperature rise is assigned for the melting point of the wax.

The water absorption of the toner and polar resin in the present invention is measured using a trace water content measuring apparatus (AQ-6; Hiranuma Sangyo K. K.) after 0.5±0.1 g of sample has been left to stand in an environment of 23° C./60% RH for at least 3 days. (Reagent for titration: Hydranal Aqualite RS) The sample is heated in an automatic water vaporizer (SE-24; Hiranuma Sangyo K. K.), connecting the AQ-6 through an interface. (Temperature: 110° C.; $N_2$ gas: 0.25 liter/min.) In the case of the polar resin, a powdery sample with a weight average particle diameter D4 of about 8 μm is used.

The hydrophobicity of the inorganic oxide used in the present invention is judged by the "methanol titration test" described below.

To 50 ml of water in a Erlenmeyer flask of 250 ml in volume, 0.2 g of fine inorganic oxide powder is added. Methanol is dropwise added from a buret until silica has been swelled in its entirety. On this occasion, the solution in the flask is always stirred using a magnetic stirrer. The end point can be observed upon suspension of the whole fine silica powder in the solution, and the hydrophobicity is expressed as percentage of the methanol in the liquid mixture comprising methanol and water, when the end point is reached.

Even when the inorganic oxide is externally added to the toner, the wettability of the toner to water is influenced by the hydrophobicity of the inorganic oxide. Hence, even if the toner and the inorganic oxide are not separated, the hydrophobicity of the inorganic oxide can be judged.

In the present invention, the molecular weight distribution of the toner on the chromatogram obtained by GPC is measured under the following conditions, using THF (tetrahydrofuran) as a solvent.

Columns are stabilized in a heat chamber of 40° C. To the columns kept at this temperature, THF as a solvent is flowed at a flow rate of 1 ml per minute, and about 100 μl of THF sample solution is injected thereinto to make measurement. In measuring the molecular weight of the sample, the molecular weight distribution ascribed to the sample is calculated on the basis of the relationship between the logarithmic value and count number of a calibration curve prepared using several kinds of monodisperse polystyrene standard samples. As the standard polystyrene samples used for the preparation of the calibration curve, it is suitable to use samples with molecular weights of from $10^2$ to $10^7$, which are available from Toso Co., Ltd. or Showa Denko KK., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF- 801, KF-802, KF-803, KF-804, KF-805, KF-806, KF-807 and KF-800P, available from Showa Denko K. K.; or a combination of TSKgel G1000H($H_{XL}$), G2000H($H_{XL}$), G3000H($H_{XL}$), G4000H($H_{XL}$), G5000H($H_{XL}$), G6000H($H_{XL}$), G7000H($H_{XL}$) and TSK guard column, available from Toso Co., Ltd.

The sample is prepared in the following way: The binder resin or the magnetic toner is put in THF, and is left to stand for several hours, followed by thorough shaking so as to be well mixed with the THF (until a block of the sample has disappeared), which is further left to stand for at least 12 hours. At this time, the sample is so left as to stand in THF for at least 24 hours in total. Thereafter, the solution which has been passed through a sample-treating filter (pore size: 0.45 to 0.5 μm; for example, MAISHORI DISK-25-5, available from Toso Co., Ltd. or EKICHRO DISK 25CR, available from German Science Japan, Ltd., can be utilized), is used as the sample for GPC. The sample is so adjusted to have resin components in a concentration of from 0.5 to 5 mg/ml.

In the present invention, the toner described above and a carrier may be used in combination to give a two-component developer for developing an electrostatic image.

The carrier may include magnetic particles such as iron powder arid ferrite powder, and magnetic particles such as magnetic particle dispersed resin particles in which finely divided powder of the magnetic particles is dispersed in resin.

The magnetic particles may be used as the carrier as they are. Magnetic particles whose surfaces are coated with a resin containing a charge controlling compound are particularly preferable since they have a high charge-generating effect, which makes the rise of charge speedier.

This charge controlling compound includes charge controlling compounds with positive polarity and those with negative polarity. In particular, in the case where the toner particles contain the polyester resin in their surfaces and the toner is negatively chargeable, the charge controlling compound used in the resin with which the magnetic particle surfaces are coated :may preferably have negative polarity. The reason for this is presumably that those as being relatively closer in the level of charge have a higher charge generation efficiency.

The charge controlling compound with positive polarity may include cationic polymers as exemplified by copolymers of nitrogen-containing monomers such as dimethylaminoethyl methacrylate and diethylaminoethyl methacrylate with styrene monomers or unsaturated carboxylic acid ester monomers, Nigrosine dyes, triphenylmethane dyes, quaternary ammonium salts, and amine compounds.

The charge controlling compound with negative polarity may include homopolymers or copolymers of monomers such as nitrile monomers, halogen-containing monomers, unsaturated carboxylic acid monomers, unsaturated dibasic acid monomers, unsaturated dibasic acid anhydride monomers and nitro monomers, or copolymers of these monomers with styrene monomers, anionic polymers such as polyester resins, metal-containing salicylic acid compounds, and metal-containing monoazo compounds. Among these, metal-containing salicylic compounds are preferred. In particular, the following compound is preferred.

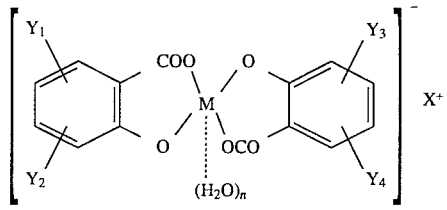

wherein M represents Co, Ni, Cu, Cr or Fe; $X^+$ represents a cation; $Y_1$, $Y_2$, $Y_3$ and $Y_4$ each represent a hydrogen atom, a halogen atom, an alkyl group or an alkoxyl group; and n represents an integer of 0 to 2.

The two-component developer which uses the carrier as described above that can improve the rise of charge, also gives: a uniform charge distribution, so that the fluidity of the two-component developer can be improved. The reason therefor is presumably that an attractive force hardly acts between toner particles under uniform charge distribution.

The magnetic particles used in the two-component developer of the present invention should preferably have a weight average particle diameter of from 5 to 100 μm, and more preferably from 20 to 80 μm, in view of fine-line reproduction and highlight reproduction in image formation.

The toner of the present invention and the two-component developer containing this toner and the carrier contain toner particles prepared by suspension polymerization of the monomer composition containing at least the polymerizable monomers, the specific polyester resin and the specific paraffin wax. Hence, (i) because the toner has a water absorption of from 300 to 5,000 ppm, they are suited for high-speed image formation and full-color formation, can achieve a speedy rise of charge and can give electrostatic charges in a stable quantity over a long period of time, (ii) they can give a high image density, and an image with superior fine-line reproduction and highlight reproduction, because of superior fluidity, and (iii) they have superior fixing performance and blocking resistance.

EXAMPLES

The present invention will be specifically described below by giving Examples. In the following formulation, "part(s)," refers to "part(s) by weight" in all occurrences.

Example 1

An aqueous 0.1M $Na_3PO_4$ solution and an aqueous 1M $CaCl_2$ solution were prepared. Into a 2 liter flask of a TK-type homomixer (manufactured by Tokushu Kika Kogyo Co., Ltd.), 322 g of aqueous 0.1M $Na_3PO_4$ solution and 850 g of ion-exchanged water were introduced, and the mixture was stirred at 12,000 rpm. Then, 48.4 g of aqueous 0.1M $CaCl_2$ solution was added little by little with stirring using the above homomixer heated to 60° C., to give a dispersion medium containing $Ca_3(PO_4)_2$.

| | |
|---|---|
| Styrene | 180 g |
| 2-Ethylhexyl acrylate | 20 g |
| Paraffin wax (m.p.: 75° C.) | 60 g |
| C.I. Pigment Blue 15 | 10 g |
| Polyester resin (bisphenol A/fumaric acid; Mw: 10,000; acid value: 10; water absorption: 3,000 ppm) | 10 g |
| Di-tert-butylsalicylic acid metal compound | 1 g |

Of the above materials, only the C.I. Pigment Blue 15, di-tert-butylsalicylic acid metal compound and styrene were pre-mixed, Next, all the materials were heated to 60° C., and dissolved and dispersed to give a monomer mixture. While maintaining the mixture at 60° C., 10 g of 2,2'azobis(2,4-dimethylvaleronitrile) and 1 g of dimethyl 2,2'-azobisisobutyrate as polymerization initiators were added and dissolved therein. A monomer composition was thus prepared.

The monomer composition obtained was introduced into the dispersion medium prepared in the 2 liter flask of the above homomixer, followed by stirring at 10,000 rpm for 20 minutes at 60° C. using the TK homomixer in an atmosphere of nitrogen, to carry out granulation of the monomer composition. Thereafter, while stirring with paddle stirring blades, the reaction was carried out at 60° C. for 6 hours, and then the temperature was raised to 80° C. to carry out polymerization for further 10 hours.

After the polymerization reaction was completed, the reaction product was cooled, and hydrochloric acid was added to dissolve the $Ca_3(PO_4)_2$, followed by filtration, washing with water and drying to give toner particles.

Particle diameter of the toner particles obtained was measured using a Coulter counter to reveal that the toner particles had a weight average particle diameter of 8.6 μm and had a sharp particle size distribution.

Next, based on 100 parts by weight of the toner particles thus obtained, 0.7 part of silica fine powder having a BET surface specific area of 200 $m^2$ and having been subjected to hydrophobic treatment using hexamethyldisilazane was externally added to give a toner. Water absorption of the toner thus obtained was measured to reveal that it was 1,000 ppm.

Then, based on 7 parts of this toner, 93 parts of ferrite carrier having an average particle diameter of 50 μm and coated with a styrene-methyl methacrylate resin containing a di-tert-butylsalicylic acid metal compound in an amount of 10% by weight on the basis of the weight of the styrene-methyl methacrylate resin was blended to give a two-component developer.

Using the two-component developer thus obtained, a running test on 20,000 copy sheets were made using a modified machine of a full-color copying machine CLC-500, manufactured by Canon Inc. Results obtained are shown in Table 1.

Examples 2 to 5 and Comparative Examples 1 to 12

According to the formulation as shown in Table 1, the same procedure as in Example 1 was repeated to give the respective toners and two-component developers. Running tests were also made similarly. Results obtained are shown in Table 1.

TABLE 1

Toner Formulation and Physical Properties

| | Polyester resin | | | Wax | | | Toner resin | Water |
|---|---|---|---|---|---|---|---|---|
| | AV | Mw | Cont. | Kind | m.p. | Cont. | Mw | absorption |
| Example: | | | | | | | | ppm |
| 1 | 10 | 10,000 | 5% | Pf | 75° C. | 30% | 40,000 | 1,000 |
| 2 | 20 | 12,000 | 5% | Pf | 75° C. | 20% | 42,000 | 1,500 |
| 3 | 40 | 8,000 | 5% | Pf | 75° C. | 30% | 35,000 | 2,500 |
| 4 | 10 | 10,000 | 5% | Pf | 75° C. | 30% | 40,000 | 1,050 |
| 5 | 10 | 10,000 | 4% | Pf | 75° C. | 30% | 40,000 | 500 |
| Comparative Example:* | | | | | | | | |
| 1 | 0 | 15,000 | 5% | PP | 145° C. | 10% | 40,000 | 250 |
| 2 | 10 | 30,000 | 5% | Pf | 75° C. | 30% | 40,000 | 280 |
| 3 | 10 | 10,000 | 5% | Pf | 75° C. | 10% | 40,000 | 260 |
| 4 | 10 | 10,000 | 5% | Pf | 75° C. | 60% | — | — |
| 5 | 60 | 10,000 | 5% | Pf | 75° C. | 30% | — | — |
| 6 | 10 | 900 | 5% | Pf | 75° C. | 30% | 40,000 | 1,200 |
| 7 | 10 | 20,000 | 5% | Pf | 75° C. | 30% | 40,000 | 1,100 |
| 8 | 10 | 10,000 | 20% | Pf | 75° C. | 30% | 40,000 | 5,500 |
| 9 | 10 | 10,000 | 5% | Pf | 40° C. | 30% | 40,000 | 900 |
| 10 | 10 | 10,000 | 5% | PE | 100° C. | 30% | 40,000 | 270 |
| 11 | 10 | 10,000 | 5% | Pf | 75° C. | 30% | 4,500 | 800 |
| 12 | 10 | 10,000 | 5% | Pf | 75° C. | 30% | 70,000 | 1,100 |

AV: Acid value
Pf: Paraffin
PP: Polypropylene
PE: Polyethylene

Results of Evaluation

| | *1 | *2 | *3 | *4 | Comments on *4 | Remarks |
|---|---|---|---|---|---|---|
| Example: | | | | | | |
| 1 | AA | AA | AA | AA | C1 | R1 |
| 2 | AA | AA | AA | AA | C1 | R2 |
| 3 | AA | AA | AA | AA | C1 | R2 |
| 4 | AA | AA | AA | AA | C1 | R3 |
| 5 | AA | AA | AA | AA | C1 | R3 |

TABLE 1-continued

| Comparative Example: | | | | | | |
|---|---|---|---|---|---|---|
| 1 | B | A | A | B | C2 | R4 |
| 2 | B | AA | AA | B | C2 | R5 |
| 3 | B | AA | AA | B | C2 | |
| 4 | — | — | — | — | — | R6 |
| 5 | — | — | — | — | — | R6 |
| 6 | A | C | A | C | C3 | |
| 7 | A | AA | B | B | C4 | |
| 8 | B | A | B | B | C5 | |
| 9 | A | C | AA | C | C6 | |
| 10 | B | A | A | B | C7 | |
| 11 | A | C | A | C | C4 | |
| 12 | AA | AA | AA | — | C8 | |

In Table 1;
*1: Charge performance:
AA: Very good.
A: Good.
B: Tolerable in practical use.
*2: Blocking resistance:
The toner was left to stand in an environment of 50° C. to evaluate blocking resistance.
AA: No caking of toner occurred in 7 days or more.
A: No caking of toner occurred for 5 days.
B: No caking of toner occurred for 3 days.
C: Caking of toner occurred in less than 3 days.
*3: Granulation performance:
Evaluated on the basis of the coefficient of variation (S.D.) calculated by measurement using a Coulter counter.
AA: Less than 35%.
A: Between 35% and less than 38%.
B: Between 38% and less than 40%.
C: 40% or more.
*4: Evaluation of image reproduction:
Running durability was examined in an environment of high temperature and high humidity H/H (30° C., 80% RH) and an environment of low temperature and low humidity L/L (23° C., 5% RH).
AA: 1,000 sheets or more.
A: Between 5,000 sheets and less than 10,000 sheets.
B: Between 3,000 sheets and less than 5,000 sheets.
C: Less than 3,000 sheets.
Comments on *4:
C1: No trouble occurred throughout continuous copying on 10,000 sheets.
C2: The rise of charge was slow to cause a decrease in image density under L/L.
C3: The fluidity of toner was poor to cause a lowering of halftone reproduction.
C4: Lowering of fine-line reproduction occurred.
C5: The charge performance was poor to cause fogging under H/H.
C6: Lowering of halftone reproduction occurred.
C7: Decrease in image density occurred under L/L.
C8: Color mixing with the toner of Example 4 was so poor that no clear green color was obtained.
Remarks:
R1: A polyester resin comprised of bisphenol A and fumaric acid.
R2: A polyester resin comprised of bisphenol A, terephthalic acid and trimellitic acid.
R3: The pigment used in Example 1 was replaced with a yellow pigment.
R4: A polyester resin comprised of ethylene glycol and terephthalic acid.
R5: The polyester resin was replaced with a styrene-methacrylic acid-methyl methacrylate copolymer.
R6: No toner was formed.
*Polyester resins used in comparative examples other than Comparative Examples 1 and 2 have the same composition as that of Example 1.

Example 6

The two-component developer having the cyan toner prepared in Example 1 and the two-component developer having the yellow toner prepared in Example 4 were used in a full-color copying machine CLC-500, manufactured by Canon Inc., to form green images. As a result, sharp green images with good color mixing performance were obtained and also good fixing performance was seen. Besides, no offset phenomenon occurred even when a running test was made on 10,000 copy sheets.

We claim:

1. A toner for developing an electrostatic image, comprising toner particles and an inorganic oxide, wherein said toner particles having been prepared by polymerizing in an aqueous medium a monomer composition containing at least polymerizable monomers, a paraffin wax and a polyester resin;

said toner particles contain from 0.1% by weight to 15% by weight of a polyester resin having an acid value from 5 mg KOH/g to 50 mg KOH/g and a weight average molecular weight from 1,000 to 14,000 and from 16% by weight to 50% by weight of a paraffin wax having a melting point of from 50° to 90° C.;

resin components in said toner particles, containing polymers produced by polymerization of the polymerizable monomers and the polyester resin, have a weight average molecular weight from 5,000 to 45,000;

said inorganic oxide has a BET specific surface area of not less than 80 $m^2/g$; and said toner has a water absorption from 300 ppm to 5,000 ppm.

2. The toner according to claim 1, wherein said toner has a water absorption of from 500 ppm to 3,000 ppm.

3. The toner according to claim 1, wherein said toner particles contain said polyester resin in the surface layer of each particle.

4. The toner according to claim 1, wherein said polyester resin has an acid value of from 5 mg KOH/g to 40 mg KOH/g.

5. The toner according to claim 1, wherein said polyester resin has an water absorption of not less than 1,000 ppm.

6. The toner according to claim 1, wherein said polyester resin has an water absorption of not less than 2,000 ppm.

7. The toner according to claim 1, wherein said polyester resin comprises a polybasic acid and a polyhydric alcohol, and is soluble in said polymerizable monomers.

8. The toner according to claim 1, wherein said toner particles contains said polyester resin in an amount of from 0 5% by weight to 12% by weight.

9. The toner according to claim 1, wherein said toner particles contains said polyester resin in an amount of from 1% by weight to 10% by weight.

10. The toner according to claim 1, wherein said paraffin wax has a melting point of from 60° C. to 80° C.

11. The toner according to claim 1, wherein said paraffin wax comprises paraffin, an oxide of paraffin or a modified product of paraffin.

12. The toner according to claim 1, wherein said toner particles contain said paraffin wax in an amount of from 16% by weight to 40% by weight.

13. The toner according to claim 1, wherein said toner particles contain said paraffin wax in an amount of from 16% by weight to 30% by weight.

14. The toner according to claim 1, wherein the resin components of said toner particles formed by suspension polymerization of said polymerizable monomers have a flow-out point of from 65° C. to 100° C. as measured using a flow tester.

15. The toner according to claim 1, wherein the resin components of said toner particles formed by suspension polymerization of said polymerizable monomers have a flow-out point of from 70° C. to 90° C. as measured using a flow tester.

16. The toner according to claim 1, wherein the resin components; of said toner particles formed by suspension polymerization of said polymerizable monomers have a weight average molecular weight of from 8,000 to 42,000.

17. The toner according to claim 1, wherein said polymerizable monomers comprises a styrene monomer, an acrylate monomer, a methacrylate monomer, an acrylonitrile monomer, a methacrylonitrile monomer or an acrylamide monomer.

18. The toner according to claim 1, wherein said toner particles each have a phase-separated structure comprised of phase-B mainly composed of component-B comprising said paraffin wax, present in the core of each particle, and phase-A mainly composed of component-A comprising a polymer produced by polymerization of said polymerizable monomers, present at the surface layer of each particle.

19. The toner according to claim 1, wherein said toner particles contain a polar polymer.

20. The toner according to claim 19, wherein said polar polymer comprises an anionic polymer or a cationic polymer.

21. The toner according to claim 1, wherein said toner particles contain a polar polymer in an amount of from 0.1% by weight to 15% by weight.

22. The toner according to claim 1, wherein said toner particles contain a polar polymer in an amount of from 0.5% by weight to 12% by weight.

23. The toner according to claim 1, wherein said toner particles are obtained by suspension polymerization of said monomer composition, carried out in an aqueous dispersion medium containing a dispersion stabilizer.

24. The toner according to claim 23, wherein said aqueous dispersion medium contains said dispersion stabilizer in an amount of from 0.2 part by weight to 20 parts by weight based on 100 parts by weight of said polymerizable monomers.

25. The toner according to claim 23, wherein said aqueous dispersion medium further contains a surface active agent.

26. The toner according to claim 25, wherein said aqueous dispersion medium contains said surface active agent in an amount of from 0.001 part by weight to 0.1 part by weight based on 100 parts by weight of said polymerizable monomers.

27. The toner according to claim 1, wherein said toner particles are obtained by suspension polymerization of said monomer composition, carried out in an aqueous dispersion medium containing calcium phosphate.

28. The toner according to claim 1, wherein said inorganic oxide has a hydrophobicity of not less than 10%.

29. The toner according to claim 1, wherein said inorganic oxide comprises a fine silica powder, a fine alumina powder OF a fine titanium oxide powder.

30. The toner according to claim 1, wherein said toner contains said toner particles and an additive selected from the group consisting of a fluidity-providing agent, an abrasive, a lubricant and charge controlling particles.

31. The toner according to claim 30, wherein said toner contains said additive in an amount of from 0.1 part by weight to 10 parts by weight based on 100 parts by weight of said toner particles.

32. The toner according to claim 1, wherein said inorganic oxide has been subjected to hydrophobic treatment.

33. A two-component developer for developing an electrostatic image, which comprises a toner comprising toner particles and an inorganic oxide, and a carrier wherein;

said toner particles having been prepared by polymerizing in an aqueous medium a monomer composition containing at least polymerizable monomers, a paraffin wax and a polyester resin;

said toner particles contain from 0.1% by weight to 15% by weight of a polyester resin having an acid value from 5 mg KOH/g to 50 mg KOH/g and a weight average molecular weight from 1,000 to 14,000 and from 16% by weight to 50% by weight of a paraffin wax having a melting point of from 50° to 90° C.;

resin components in said toner particles containing polymers produced by polymerization of the polymerizable monomers and the polyester resin, have a weight average molecular weight from 5,000 to 45,000;

said inorganic oxide has a BET specific surface area of not less than 80 $m^2/g$;

said toner has a water absorption from ppm to 5,000 ppm; and said carrier comprises magnetic particles.

34. The two-component developer according to claim 33, wherein said magnetic particles comprise an iron powder, a ferrite powder, or magnetic powder dispersed resin particles in which a finely divided powder of the iron powder or ferrite powder is dispersed in a resin.

35. The two-component developer according to claim 33, wherein said magnetic particles are coated on their surfaces with a resin containing a charge controlling compound.

36. The two-component developer according to claim 33, wherein said toner comprises a negatively chargeable toner, and said carrier comprises magnetic particles coated on their surfaces with a resin containing a charge controlling compound having a negative polarity.

37. The two-component developer according to claim 33, wherein said magnetic particles are coated on their surfaces with a resin containing a metal-containing salicylic acid compound.

38. The two-component developer according to claim 33, wherein said magnetic particles are coated on their surfaces with a resin containing a compound represented by the following formula:

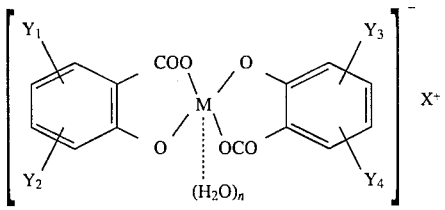

wherein M represents Co, Ni, Cu, Cr or Fe; $X^+$ represents a cation; $Y_1$, $Y_2$, $Y_3$ and $Y_4$ each represent a hydrogen atom, a halogen atom, an alkyl group or an alkoxyl group; and n represents an integer of 0 to 2.

39. The two-component developer according to claim 33, wherein said toner has a water absorption of from 500 ppm to 3,000 ppm.

40. The two-component developer according to claim 33, wherein said toner particles contain said polyester resin in the surface layer of each particle.

41. The two-component developer according to claim 33, wherein said polyester resin has an acid value of from 5 mg KOH/g to 40 mg KOH/g.

42. The two-component developer according to claim 33, wherein said polyester resin has a water absorption of not less than 1,000 ppm.

43. The two-component developer according to claim 33, wherein said polyester resin has a water absorption of not less than 2,000 ppm.

44. The two-component developer according to claim 33, wherein said polyester resin comprises a polybasic acid and a polyhydric alcohol and is soluble in said polymerizable monomers.

45. The two-component developer according to claim 33, wherein said toner particles contain said polyester resin in an amount of from 0.5% by weight to 12% by weight.

46. The two-component developer according to claim 33, wherein said toner particles contain said polyester resin in an amount of from 1% by weight to 10% by weight.

47. The two-component developer according to claim 33, wherein said paraffin wax has a melting point of from 60° C. to 80° C.

48. The two-component developer according to claim 33, wherein said paraffin wax comprises paraffin, an oxide of paraffin or a modified product of paraffin.

49. The two-component developer according to claim 33, wherein said toner particles contain said paraffin wax in an amount of from 16% by weight to 40% by weight.

50. The two-component developer according to claim 33, wherein said toner particles contain said paraffin wax in an amount of from 16% by weight to 30% by weight.

51. The two-component developer according to claim 33, wherein the resin components of said toner particles formed by suspension polymerization of said polymerizable monomers have a flow-out point of from 65° C. to 100° C. as measured using a flow tester.

52. The two-component developer according to claim 33, wherein the resin components of said toner particles formed by suspension polymerization of said polymerizable monomers have a flow-out point of from 70° C. to 90° C. as measured using a flow tester.

53. The two-component developer according to claim 33, wherein the resin components of said toner particles formed by suspension polymerization of said polymerizable monomers have a weight average molecular weight of from 8,000 to 42,000.

54. The two-component developer according to claim 33, wherein said polymerizable monomers comprise a styrene monomer, an acrylate monomer, a methacrylate monomer, an acrylonitrile monomer, a methacrylonitrile monomer or an acrylamide monomer.

55. The two-component developer according to claim 33, wherein said toner particles each have a phase-separated structure comprised of a phase-B mainly composed of component-B which comprises said paraffin wax, present in the core of each particle, and a phase-A mainly composed of component-A which comprises a polymer produced by polymerization of said polymerizable monomers present at the surface layer of each particle.

56. The two-component developer according to claim 55, wherein said toner particles contain a polar polymer.

57. The two-component developer according to claim 56, wherein said polar polymer comprises an anionic polymer or a cationic polymer.

58. The two-component developer according to claim 56, wherein said toner particles contain a polar polymer in an amount of from 0.1% by weight to 15% by weight.

59. The two-component developer according to claim 33, wherein said toner particles contain a polar polymer in an amount of from 0.5% by weight to 12% by weight.

60. The two-component developer according to claim 33, wherein said toner particles are obtained by suspension polymerization of said monomer composition, carried out in an aqueous dispersion medium containing a dispersion stabilizer.

61. The two-component developer according to claim 60, wherein said aqueous dispersion medium contains said dispersion stabilizier in an amount of from 0.2 part by weight to 20 parts by weight based on 100 parts by weight of said polymerizable monomers.

62. The two-component developer according to claim 60, wherein said aqueous dispersion medium further contains a surface active agent.

63. The two-component developer according to claim 62, wherein said aqueous dispersion medium contains said surface active agent in an amount of from 0.001 part by weight to 0.1 part by weight based on 100 parts by weight of said polymerizable monomers.

64. The two-component developer according to claim 33, wherein said toner particles are obtained by suspension polymerization of said monomer composition, carried out in an aqueous dispersion medium containing calcium phosphate.

65. The two-component developer according to claim 33, wherein said inorganic oxide has a hydrophobicity of not less than 10%.

66. The two-component developer according to claim 33, wherein said inorganic oxide comprises a fine silica powder, a fine alumina powder or a fine titanium oxide powder.

67. The two-component developer according to claim 33, wherein said toner contains said toner particles and an additive selected from the group consisting of a fluidity-providing agent, an abrasive, a lubricant and charge controlling particles.

68. The two-component developer according to claim 67, wherein said toner contains said additive in an amount of from 0.1 part by weight to 10 parts by weight based on 100 parts by weight of said toner particles.

69. The two-component developer according to claim 33, wherein said inorganic oxide has been subjected to hydrophobic treatment.

* * * * *

UNITED STATES PATENT AND TRADEMARK OFFICE

CERTIFICATE OF CORRECTION

PATENT NO. : 5,558,967

DATED : September 24, 1996

INVENTOR(S) : TAKAYUKI NAGATSUKA ET AL.

It is certified that error appears in the above-identified patent and that said Letters Patent is hereby corrected as shown below:

COLUMN 1

Line 37, "effects" should read --effect--.
Line 39, "produced" should read --produce--.

COLUMN 2

Line 41, "wherein;" should read --wherein:--.
Line 60, "wherein" should read --wherein:--.

COLUMN 6

Line 24, "disireal" should read --desired--.

COLUMN 7

Line 1, "mathacrylic" should read --methacrylic--.

COLUMN 8

Line 12, "acton" should read --action--.
Line 31, "2,2'-azobisisobutyronitrile)," should read --2,2'-azobis-(isobutyronitrile),--.
Line 60, "desiral" should read --desired--.

COLUMN 10

Line 28, "RS)" should read --RS.)--.

UNITED STATES PATENT AND TRADEMARK OFFICE

CERTIFICATE OF CORRECTION

PATENT NO. : 5,558,967

DATED : September 24, 1996

INVENTOR(S) : TAKAYUKI NAGATSUKA ET AL.

It is certified that error appears in the above-identified patent and that said Letters Patent is hereby corrected as shown below:

COLUMN 11

Line 46, ":may" should read --may--.

COLUMN 12

Line 16, "gives:" should read --gives--.
Line 67, "pre-mixed," should read --pre-mixed.--.

COLUMN 15

Line 64, "wherein" should read --wherein:--.

COLUMN 17

Line 9, "an" should read --a--.
Line 11, "an" should read --a--.
Line 15, "contains" should read --contain--.
Line 16, "05%" should read --0.5%--.
Line 18, "contains" should read --contain--.
Line 41, "components;" should read --components--.

COLUMN 18

Line 20, "OF" should read --or--.
Line 32, "wherein;" should read --wherein:--.
Line 44, "particles" should read --particles,--.
Line 50, "from ppm" should read --from 300 ppm--.

UNITED STATES PATENT AND TRADEMARK OFFICE

CERTIFICATE OF CORRECTION

PATENT NO. : 5,558,967

DATED : September 24, 1996

INVENTOR(S) : TAKAYUKI NAGATSUKA ET AL. Page 3 of 3

It is certified that error appears in the above-identified patent and that said Letters Patent is hereby corrected as shown below:

COLUMN 20

Line 32, "stabilizier" should read --stabilizer--.

Signed and Sealed this

Tenth Day of June, 1997

Attest:

Bruce Lehman

BRUCE LEHMAN

Attesting Officer

Commissioner of Patents and Trademarks